US006119285A

United States Patent [19]

Kim

[11] Patent Number: 6,119,285

[45] **Date of Patent: *Sep. 19, 2000**

[54] COMBINATION, SELF FLUSH, URINAL AND HAND WASH LAVATORY FIXTURE

[76] Inventor: Sun Y. Kim, 2384 Lancaster Ct., Hayward, Calif. 94542

[ * ] Notice: This patent is subject to a terminal disclaimer.

[21] Appl. No.: 09/236,760

[22] Filed: Jan. 25, 1999

Related U.S. Application Data

[63] Continuation-in-part of application No. 08/903,659, Jul. 31, 1997, Pat. No. 5,862,546.

[51] Int. Cl.[7] ..... A47K 4/00

[52] U.S. Cl. ..... 4/665; 4/304; 4/628; 4/623

[58] Field of Search ..... 4/665, 301, 302, 4/304, 628, 305, 310, 623

[56] References Cited

U.S. PATENT DOCUMENTS 2,182,979 12/1939 Bruzenak ..... 4/310
5,855,029 1/1999 Flippen, Sr. ..... 4/665

*Primary Examiner*—David J. Walczak
*Attorney, Agent, or Firm*—Richard Esty Peterson

[57] ABSTRACT

A lavatory fixture having a combination, urinal and hand wash faucet for public restrooms, particularly in high traffic locations such as airports, the lavatory fixture having a urinal and hand sink combined in a single lavatory unit with a self-activated hand faucet being positioned above a urinal catch basin, the hand faucet having an associated proximity sensor to activate a water flow for washing hands, when a user's hands are placed proximate the faucet, and the urinal having an associated proximity sensor for sensing the presence of a user proximate the urinal to flush the urinal when the user moves away from the urinal, the lavatory fixture having a common drain and an optional hand soap dispenser.

12 Claims, 2 Drawing Sheets

COMBINATION, SELF FLUSH, URINAL AND HAND WASH LAVATORY FIXTURE

This is a continuation-in-part of application Ser. No. 08/903,659, filed Jul. 31, 1997, now U.S. Pat. No. 5,862, 546.

BACKGROUND OF THE INVENTION

This invention relates to a urinal and hand wash faucet combined in a single lavatory fixture with a common drain. In particular, this invention relates to a combined urinal and hand wash faucet that automatically dispenses wash water through the faucet when the user's hands are placed proximate the faucet, and, that automatically flushes the urinal when the user has moved away from the urinal after completing his urination and hand wash.

The combined urinal and hand faucet fixture is particularly designed for public restrooms where it is desirable to efficiently maintain a high degree cleanliness. In the past, self flushing urinals have substantially improved the maintenance of a clean urinal by requiring that the urinal flushes each and every time after a use. Unfortunately, the user must then walk to a hand wash sink to complete this bodily function in a sanitary and conscious manner. However, frequently in a public restroom there may be few hand wash sinks available for the number of bathroom users. This deficiency is particularly acute in high traffic areas such as airports and other modern transportation facilities. In such facilities, groups of patrons are discharged at periodic times that cause the capacity of a bathroom facility to be taxed to its limit. Additionally, even when the bathroom task has been completed by a hand wash at conventional sink station, the faucet knobs may become contaminated and the sink station may become wet and littered. Furthermore, frequently travelers are burdened with luggage that is awkward to move from a urinal station to a hand wash station.

As an improvement in such environments, the hand wash sink may include a faucet that automatically dispenses warm water when the hands are placed proximate the faucet. While this substantially improves the sanitation of using a separate urinal and sink, this does not eliminate the problem of a wet and littered sink station. Most importantly, however, is the inefficient use of valuable floor space in providing multiple sinks to match the capacity of users predictably using a bathroom primarily for urination.

Although it may not be psychologically acceptable at first for individuals to use the urinal fixture for both urinating and washing one's hands, separation of a wash station from a urination station by a suitable divider in a combined unit will assist in encouraging use. Additionally, the automatic discharge of the wash water without the user having to touch the fixture is certainly convincing as to the sanitation of the device. When the user neither has to touch the faucet to wash his hands or touch a flushing handle to flush the urinal, a unitary fixture makes practical sense. Additionally, a soap dispenser can be conveniently located on the fixture with the soap discharge proximate the faucet for convenient use. Once the psychological barrier has been broken, the sanitation is improved by greater use of a hand wash facility that does not become littered by frequent use.

SUMMARY OF THE INVENTION

The combination urinal and hand wash lavatory fixture of this invention constructed with a urinal structure that may be either a suspended wall structure or a floor based structure as is conventional for urinal fixtures. However, the conventional structure is modified with an upper portion having a faucet connected to a water supply to enable a user to wash his hands when he has completed his urination. In the preferred embodiment the urinal structure includes a divider between the wash faucet and the urinal receptacle. The combination fixture combines the hand wash faucet and the urinal into a unitary lavatory fixture with a common drain.

In many public bathrooms there is commonly a surge of users, for example, during intermission at an entertainment or sporting event or after arrival of a bus, train or plane in a transportation facility. The capacity of a restroom must therefore account for this periodic dramatic increase in use. Frequently, restrooms are located where space is at a premium. Allowing a urinal and hand wash facility to be combined into a single structure provide a substantial saving in space as well as in the cost of separate urinal and sink fixtures.

The development of automatic flush urinals has greatly improved the cleanliness and sanitation of a urinal equipped with such a feature. The development of automatic water faucets that dispense water when the user places his hands proximate the faucet is not only a water saving device, but is provided as a convenience to the user, who in certain situations may be burdened with shoulder bags and the like.

Combining a urinal and hand wash faucet in a single unit, wherein both the urinal, and water faucet automatically discharge water in response to the presence of a user is both convenient to the user and an economic and space saver to the provider.

Additionally, the automatic discharge feature insures a sanitary fixture that encourages use. Use can further be encouraged by a divider between the upper hand wash portion between the lower urinal portion of the combination lavatory fixture. These and other features will become apparent from a consideration of the detailed description of the preferred embodiment.

DETAILED DESCRIPTION OF THE PREFERRED EMBODIMENTS

Figure 2:
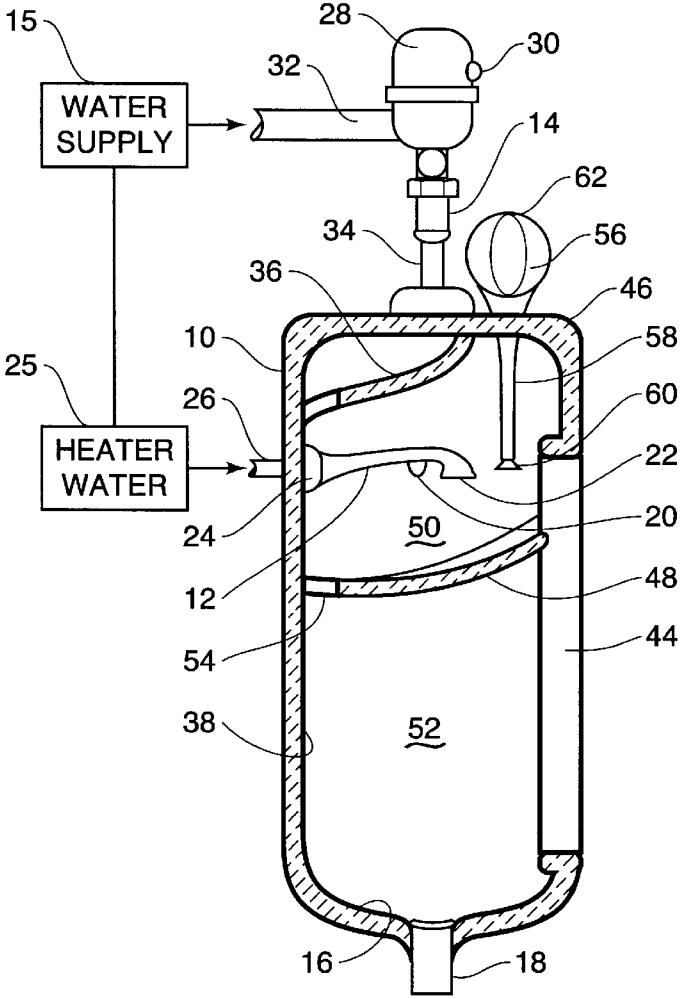
FIG. 2 is a side cross sectional view taken on the lines 2—2 in FIG. 1.

The lavatory fixture of this invention, designated by the reference numeral 10 in the drawings, is a combination urinal and hand wash structure that is particularly designed for locations where the area for a lavatory facility is limited or crowded. The lavatory fixture 10 functions both as a urinal and a hand wash sink in a single unit.

Figure 1:
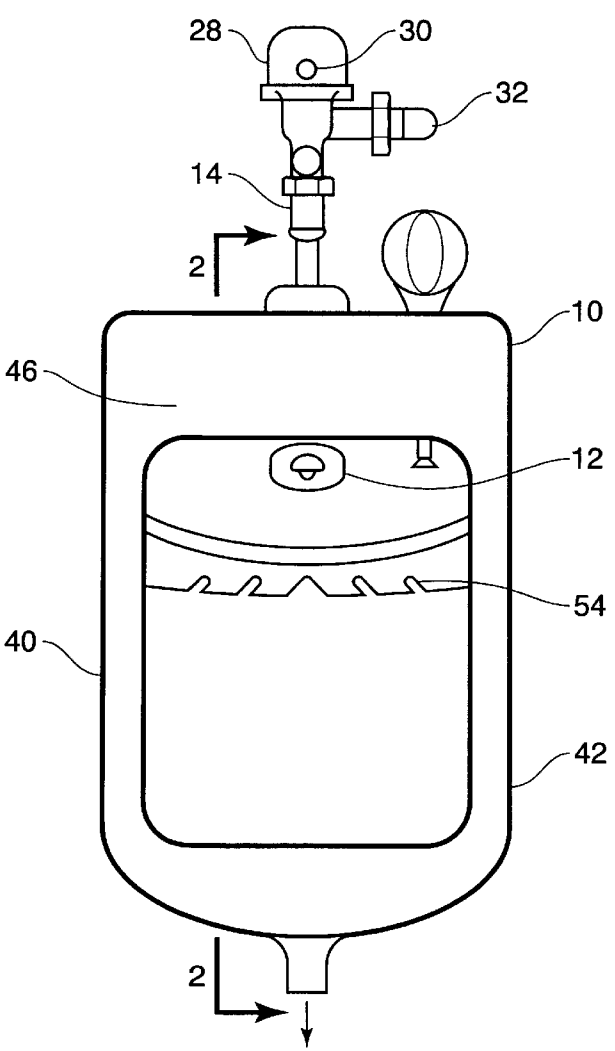
FIG. 1 is a front elevational view of the lavatory fixture.

Preferably, the combination, urinal and hand wash lavatory fixture 10 as shown in FIGS. 1 and 2 has an automatically activated hand wash faucet 12 and an automatically activated flushing mechanism 14. Water from a water supply 15 that is discharged from the faucet 12 and the flushing mechanism 14 collects in a basin 16 at the bottom of the fixture 10 and drains through a common drain 18.

The automatic water discharge from the faucet 12 is accomplished by a proximity sensor 20 located proximate the end of the faucet 12. The sensor 20 senses the presence of an object, such as the user's hand, proximate the discharged end 22 of the faucet 12 causing a valve (not visible) in a housing 24 to open allowing warm water from a heated water supply 25 that is included in the water supply 15 to pass through a conduit 26 to the faucet 12. The automatic water faucet 12 is preferably of a type manufactured by Sloan Valve Company, such as a modified model ETF-80.

Similarly, the flushing mechanism 14 can include a battery powered, sensor operated valve (not shown) in housing 28, which also houses a sensor 30. The sensor 30 emits an infrared beam that sets the internal automatic valve when a user enters the sensor's effective range and triggers the valve once the user steps away. This initiates the flush cycle to flush the fixture. Flush water enters through a supply conduit 32 and passes through a discharge conduit 34 to be deflected by a porcelain deflector 36 to the back wall 38 of the fixture 10. The fixture 10 is of conventional construction with side walls 40 and 42 with an open front 44 formed with the bottom basin 16 to collect the waste water for drainage to the common drain 18.

The feature of the automatic flush and automatic discharge of hand wash water from the faucet 12 maintain the fixture 10 in a hygienic and clean state which encourages use of the hand faucet 12. To further encourage use of the hand faucet 12, a divider 48 separates an upper hand wash portion 50 from a lower urinal portion 52. The divider 48 is contoured to suggest a sink, and is sloped to the back wall 38 allowing the wash water discharge from the faucet 12 to drain through slots 54 to the urinal portion 52 and hence to the drain 18.

As an added component, a soap fixture 56 is installed on the top shroud 46 of the fixture 10' with a tube 58 suspending into the upper hand wash portion 50 of the lavatory fixture 10. A spring loaded discharge button 60 can be operated by a user while washing his hands in the upper portion 50 of the fixture 10. The soap fixture 56 is of a common design with a globe 62 that can be refilled with liquid soap for use. The soap may include a mild disinfectant that enhances the hygienic maintenance of the lavatory fixture since the water from the sink portion 50 discharges to the wall 38 at the urinal portion 52.

The flushing mechanism 14 including the internal automatic sensor valve is preferably a battery powered mechanism, for example, of the type manufactured by Sloan Valve Company in their Optima Systems line, Model RESS-U-1.

Figure 4:
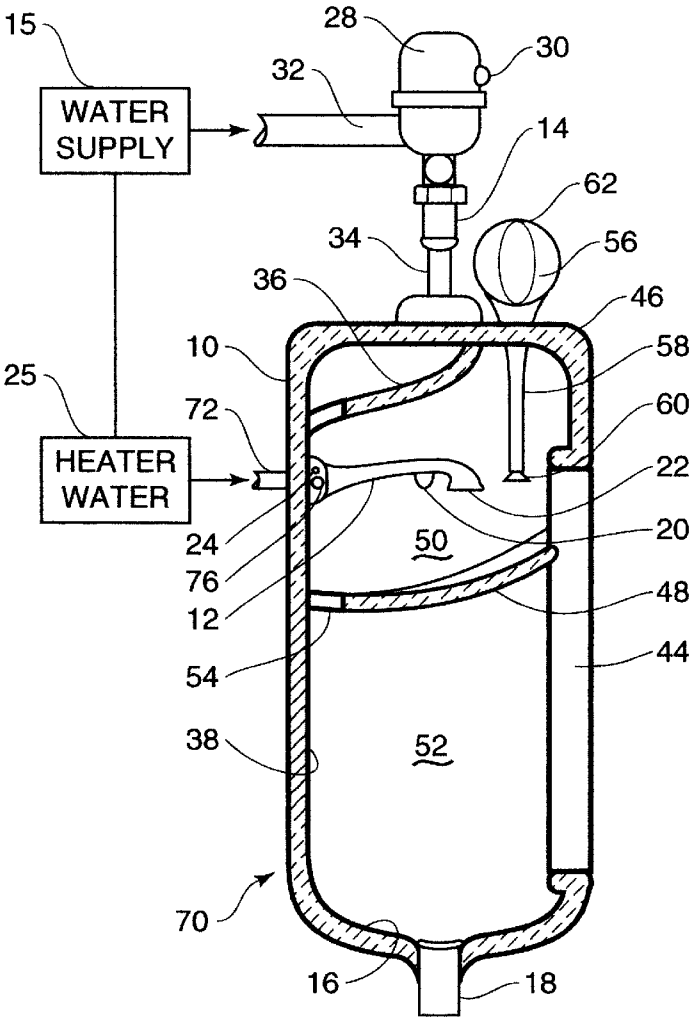
FIG. 4 is a side cross sectional view taken on the lines 4—4 in FIG. 3.
Figure 3:
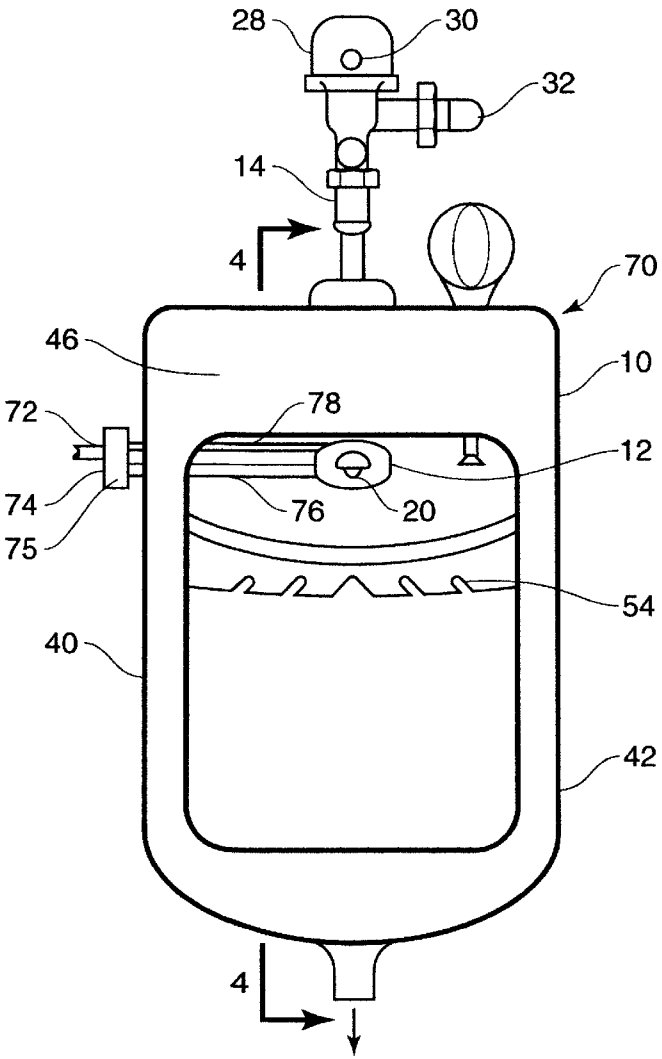
FIG. 3 is a front elevational view of an alternate embodiment of the lavatory fixture of FIG. 1.

In the alternate embodiment of FIGS. 3 and 4, the lavatory fixture 70 has almost all the same components as the embodiment of FIGS. 1 and 2, which are numbered identically. The alternate embodiment 70 has side walls 40 and 42 integrally formed with the back wall 38 with a supply conduit 72 entering through the side wall 40. In this manner the lavatory fixture can be attached to a wall structure (not shown) with the water supply mounted to the side of the lavatory fixture 70 for supplying wash water to the faucet 12. The water supply conduit 76 in the embodiment of FIG. 3 connects to an external valve containing housing 74 that houses the sensor operated valve 75 (not visible). The side entry, supply conduit 76 connects to the faucet 12 at the faucet housing 24. The sensor 20 is electrically connected to the sensor operated valve through electrical line 78. The side mounted water supply and valve housing facilitates installation and servicing of the lavatory fixture. All other operational features are the same as the embodiment of FIGS. 1 and 2.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A combination urinal and hand wash lavatory fixture comprising:

a urinal structure with an upper portion having a water supply, a lower portion having a waste water drain and a back wall extending from the upper portion to the lower portion wherein the water supply is mounted to a surface of said urinal structure which is integrally formed with the back wall, a water faucet connected to the water supply located in the upper portion of the urinal structure, the faucet having means for automatically discharging faucet water in the upper portion directed toward the lower portion for disposal through the waste water drain wherein the means for automatically discharging faucet water includes a proximity sensor and an electronically operated valve between the water supply and the water faucet wherein the water is discharged through the water faucet when the proximity sensor detects a physical object proximate the water faucet; and, separate flushing means for automatically discharging flushing water from the water supply against the back wall for disposal through the waste water drain.

2. The lavatory fixture of claim 1 wherein the urinal has a divider between the upper portion of the urinal structure and the lower portion of the urinal structure.

3. The lavatory fixture of claim 2 wherein the divider is sloped from the horizontal to direct faucet water to the back wall of the urinal structure.

4. The lavatory fixture of claim 1 wherein the urinal structure has side walls and a substantially open front.

5. The lavatory fixture of claim 4 wherein the lower portion of the urinal structure has a drain basin with the drain being located in the drain basin.

6. The lavatory fixture of claim 5 wherein the upper portion of the urinal structure has a top shroud.

7. The lavatory fixture of claim 1 wherein the water supply includes a heated water supply connected to the faucet, wherein the faucet discharges heated water.

8. The lavatory fixture of claim 1 wherein the flushing means includes electronic means for automatic discharge of flushing water.

9. The lavatory fixture of claim 8 wherein the electronic means for automatic discharge of flushing water includes a proximity sensor.

10. The lavatory fixture of claim 9 wherein the flushing means includes a flushing water discharge at the upper portion of the urinal structure, and the electronic means for automatic discharge of flushing water includes an electronically operated valve between the water supply and the flushing water discharge, wherein the electronically operated valve is set to activate when the proximity sensor detects a physical object proximate the urinal structure and activates discharging flushing water from the flushing water discharge when the detected physical object is thereafter not detected.

11. The lavatory fixture of claim 1 wherein the top portion of the urinal structure includes a soap dispenser.

12. The lavatory fixture of claim 1 wherein the lavatory fixture has side walls integrally formed with the back wall and the water supply is mounted to one of the side walls.

* * * * *